US006933454B2

(12) United States Patent
Ishibashi et al.

(10) Patent No.: US 6,933,454 B2
(45) Date of Patent: Aug. 23, 2005

(54) SWITCHING APPARATUS AND VEHICLE-MOUNTED ELECTRONIC APPARATUS HAVING THE SWITCHING APPARATUS ASSEMBLED THEREIN

(75) Inventors: Kouichi Ishibashi, Kanagawa-ken (JP); Shinichi Shinohara, Osaka-fu (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 65 days.

(21) Appl. No.: 10/664,624

(22) Filed: Sep. 19, 2003

(65) Prior Publication Data

US 2005/0061645 A1 Mar. 24, 2005

(51) Int. Cl.[7] ..... H01H 13/14; H01H 3/12

(52) U.S. Cl. ..... 200/341; 200/520; 200/345; 200/314

(58) Field of Search ..... 200/341–345, 200/520, 521, 310, 313, 314, 296

(56) References Cited

U.S. PATENT DOCUMENTS 5,087,802 A * 2/1992 Guilleminot ..... 200/343
5,193,667 A * 3/1993 Choi ..... 200/331
5,280,146 A * 1/1994 Inagaki et al. ..... 200/341
5,399,820 A * 3/1995 Silfvast ..... 200/314
5,399,821 A * 3/1995 Inagaki et al. ..... 200/341
5,496,976 A * 3/1996 Hayes ..... 200/5 A
5,803,237 A * 9/1998 Gandre et al. ..... 200/43.01
5,817,997 A * 10/1998 Wernig ..... 200/16 R
6,034,340 A * 3/2000 Aoki et al. ..... 200/345
6,392,179 B1 * 5/2002 Schwarzbich ..... 200/520

* cited by examiner

*Primary Examiner*—K. Richard Lee
(74) *Attorney, Agent, or Firm*—Pearne & Gordon LLP

(57) ABSTRACT

Herein disclosed are a switching apparatus and a vehicle-mounted electronic apparatus having the switching apparatus assembled therein. The switching apparatus comprises a rear panel; a front panel spaced apart from the rear panel and having a first surface outwardly exposed and a second surface in face-to-face relationship with the rear panel, the front panel being formed with a through bore having an outer open end flush with the first surface and an inner open end flush with the second surface; a switch device including a stationary contact member fixedly mounted on the rear panel, and a movable contact member movable with respect to the stationary contact member to assume two different positions including a switch-on position and a switch-off position; a push button having a pushed portion having a center axis extending substantially in perpendicular relationship with the first surface of the front panel and received in the through bore of the front panel, the push button supporting the movable contact member of the switch device to be reciprocatable along the center axis of the pushed portion together with the movable contact member of the switch device to assume two different positions including a projected position and a retracted position; and a stationary supporting panel disposed between the rear panel and the front panel to resiliently urge the push button toward the projected position.

11 Claims, 5 Drawing Sheets

SWITCHING APPARATUS AND VEHICLE-MOUNTED ELECTRONIC APPARATUS HAVING THE SWITCHING APPARATUS ASSEMBLED THEREIN

BACKGROUND OF THE INVENTION

1. Field of the Invention

The present invention relates to a switching apparatus and an electronic apparatus, and more particularly to a switching apparatus for carrying out a switching operation with reduced noise and an electronic apparatus having the switching apparatus assembled therein and to be incorporated in an automotive vehicle.

2. Description of the Related Art

Up until now, there have been proposed a wide variety of conventional switching apparatuses available for an electric apparatus such as, for example, a DVD (Digital Versatile Disc) Video player, a CD (Compact Disc) Video player, a cassette tape player, a radio receiver, or the like, to be incorporated in an automotive vehicle for the purpose of simple in construction and inexpensive in production cost.

One typical example of the conventional switching apparatus 300 of this type is exemplified and shown in FIG. 5 as comprising a rear panel 350 and a front panel 310 spaced apart from the rear panel 350. The front panel 310 of the conventional switching apparatus 300 in part constitutes a front panel of an electronic apparatus to be mounted on an automotive vehicle, hereinlater simply referred to as "vehicle-mounted electronic apparatus", not shown in FIG. 5. The front panel 310 has a first surface 311 outwardly exposed and a second surface 312 in face-to-face relationship with the rear panel 350. The front panel 310 is formed with a through bore 313 having an outer open end flush with the first surface 311 and an inner open end flush with the second surface 312.

The conventional switching apparatus 300 further comprises a push button 320 and a switch device 330. The switch device 330 includes a stationary contact member 333 fixedly mounted on the rear panel 350, and a movable contact member 334 movable with respect to the stationary contact member 333 to assume two different positions including a switch-on position in which the movable contact member 334 is brought in contact with the stationary contact member 333 to establish electrical connection between the movable contact member 334 and the stationary contact member 333 and a switch-off position in which the movable contact member 334 is brought out of contact with the stationary contact member 333 to establish electrical disconnection between the movable contact member 334 and the stationary contact member 333.

The push button 320 has a pushed portion 323. The pushed portion 323 of the push button 320 has a center axis extending substantially in perpendicular relationship with the first surface 311 and the second surface 312 of the front panel 310 and received in the through bore 313 of the front panel 310 to be reciprocatable along the center axis of the pushed portion 323 together with the movable contact member 334. The push button 320 is adapted to support the movable contact member 334 of the switch device 330 to be reciprocable to ensure that the movable contact member 334 is brought into and out of contact with the stationary contact member 333.

The push button 320 includes a horn projection 322 having a center axis, and pivotably engaged with the front panel 310 on the second surface 312. This means that the push button 320 is pivotably supported on the front panel 310 with the horn projection 322 around the center axis of the horn projection 322 to have the pushed portion 323 of the push button 320 reciprocated along the center axis of the pushed portion 323 to assume two different positions including a projected position in which the pushed portion 323 is projected outwardly of the outer open end of the through bore 313 to have the movable contact member 334 move with respect to the stationary contact member 333 toward the switch-off position and a retracted position in which the pushed portion 323 is in part retracted into the through bore 313 to have the movable contact member 334 move with respect to the stationary contact member 333 toward the switch-on position. The switch device 330 further includes a resilient member, not shown in FIG. 5, for resiliently urging the movable contact member 334 to have the movable contact member 334 move with respect to the stationary contact member 333 toward the switch-off position. The movable contact member 334 of the switch device 330 is opposing to and held in contact with the pushed portion 323 of the push button 320. The rattling of the push button 320 causes constituent elements forming part of the conventional switching apparatus 300 to generate a noise, hereinlater referred to as a "rattling noise". The resilient member of the switch device 330 is operative to resiliently urge the pushed portion 323 of the push button 320 to have the pushed portion 323 of the push button 320 stationary held in the projected position, thereby preventing the push button 320 from being rattled especially when an external vibration is imparted to the conventional switching apparatus 300. This leads to the fact that the resilient member of the switch device 330 serves as means to prevent the push button 320 from generating the rattling noise.

The conventional switching apparatus 300 as previously mentioned, however, encounters a drawback that the push button 320 can be held in contact with the movable contact member 334 when the pushed portion 323 of the push button 320 is reciprocatable along the center axis of the pushed portion 323 with a long stroke of, for example, 0.7 mm, 1.0 mm, or more while, on the other hand, the push button 320 cannot be held in contact with the movable contact member 334 when the pushed portion 323 of the push button 320 is reciprocatable along the center axis of the pushed portion 323 with a short stroke of approximately 0.2 mm or less. This leads to the fact that the resilient member of the switch device 330 cannot resiliently urge the pushed portion 323 of the push button 320 to have the pushed portion 323 of the push button 320 stationary held in the projected position, thereby unable to prevent the push button 320 from being rattled as well as prevent the "rattling noise" from occurring when the pushed portion 323 of the push button 320 is reciprocatable along the center axis of the pushed portion 323 with a short stroke of approximately 0.2 mm or less.

SUMMARY OF THE INVENTION

It is, therefore, an object of the present invention to provide a switching apparatus, which is noiseless in operation and simple in construction.

It is another object of the present invention to provide a vehicle-mounted electronic apparatus having assembled therein the switching apparatus, which is noiseless in operation and simple in construction.

It is a further object of the present invention to provide a switching apparatus, which can prevent the rattling noise from occurring.

It is a still further object of the present invention to provide a vehicle-mounted electronic apparatus having the switching apparatus assembled therein, which can prevent the rattling noise from occurring.

In accordance with a first aspect of the present invention, there is provided a switching apparatus, comprising: a rear panel; a front panel spaced apart from the rear panel and having a first surface outwardly exposed and a second surface in face-to-face relationship with the rear panel, the front panel being formed with a through bore having an outer open end flush with the first surface and an inner open end flush with the second surface; a switch device including a stationary contact member fixedly mounted on the rear panel, and a movable contact member movable with respect to the stationary contact member to assume two different positions including a switch-on position in which the movable contact member is brought in contact with the stationary contact member to establish electrical connection between the movable contact member and the stationary contact member and a switch-off position in which the movable contact member is brought out of contact with the stationary contact member to establish electrical disconnection between the movable contact member and the stationary contact member; a push button having a pushed portion having a center axis extending substantially in perpendicular relationship with the first surface of the front panel and received in the through bore of the front panel, the push button supporting the movable contact member of the switch device to be reciprocatable along the center axis of the pushed portion together with the movable contact member of the switch device to assume two different positions including a projected position in which the pushed portion is projected outwardly of the first surface of the front panel to have the movable contact member move with respect to the stationary contact member toward the switch-off position and a retracted position in which the pushed portion is retracted into the through bore to have the movable contact member move with respect to the stationary contact member toward the switch-on position; and a stationary supporting panel disposed between the rear panel and the front panel to resiliently urge the push button toward the projected position.

In the aforementioned switching apparatus, the push button may include a horn projection having a center axis, and the stationary supporting panel may include a base section held in pressing contact with the horn projection to have the horn projection pivotably received on the second surface of the front panel, and the stationary supporting panel further including an urging section designed to resiliently urge the push button toward the projected position. The push button may have a pushing end portion disposed in face-to-face relationship with the movable contact member of the switch device and an urged end portion disposed in face-to-face relationship with the urging section of the stationary supporting panel, the pushing end portion and the urged end portion opposing to and spaced apart from each other along the center axis of the horn projection. The push button may have a flange portion extending radially and outwardly of and integrally formed with the pushed portion. The flange portion of the push button may extend inwardly of the inner open end of the through bore, and the stationary supporting panel may be operative to resiliently urge the flange portion of the push button toward the projected position.

The aforementioned switching apparatus may further comprise: an internal light disposed opposing to and spaced apart from the second surface of the front panel and operative to project a light on the second surface of the front panel. The stationary supporting panel may be disposed between the front panel and the internal light and made of a light blocking material. The stationary supporting panel may have a light passing hole therein to have the light passing therethrough. The urging section of the stationary supporting panel may be designed to resiliently urge the push button at a point spaced apart from the light passing hole to prevent the urging section of the stationary supporting panel from intercepting the light passing through the light passing hole.

In the aforementioned switching apparatus, the front panel may be formed with a groove open at the second surface and the horn projection of the push button is received in the groove. The front panel may include a holder portion on the second surface, the holder portion may have a bottom plate fixedly supported on the front panel, a first plate and a second plate opposing to and spaced apart from each other across the bottom plate. The first plate and the second plate may be fixedly supported on the bottom plate. The first plate, the second plate, and the bottom plate may extend substantially along the center axis of the horn projection to form a groove having the horn projection received therein. The stationary supporting panel may be fixedly supported on at least one of the rear panel and the front panel to be retained at a stationary position. The stationary supporting panel may be made of plastic material.

In accordance with a second aspect of the present invention, there is provided a vehicle-mounted electronic apparatus having assembled therein the aforementioned switching apparatus.

In accordance with a third aspect of the present invention, there is provided a switching apparatus, comprising: a support member having a first surface and a second surface opposing to the first surface, the support member being formed with a through bore having an outer open end flush with the first surface and an inner open end flush with the second surface; a switch device operative to perform a switching action; a push button having a pushed portion reciprocatable through the through bore to assume two different positions including a projected position in which the pushed portion is projected outwardly of the first surface of the front support member to have the switch device perform a switch-off action and a retracted position in which the pushed portion is retracted into the through bore to have the switch device perform a switch-on action; and a stationary supporting panel disposed on the side of the second surface of the support member to resiliently urge the push button toward the projected position.

BRIEF DESCRIPTION OF THE DRAWINGS

The features and advantages of a switching apparatus and a vehicle-mounted electronic apparatus having assembled therein the switching apparatus according to the present invention will be more clearly understood from the following description taken in conjunction with the accompanying drawings in which.

DESCRIPTION OF THE EMBODIMENTS

Figure 1:
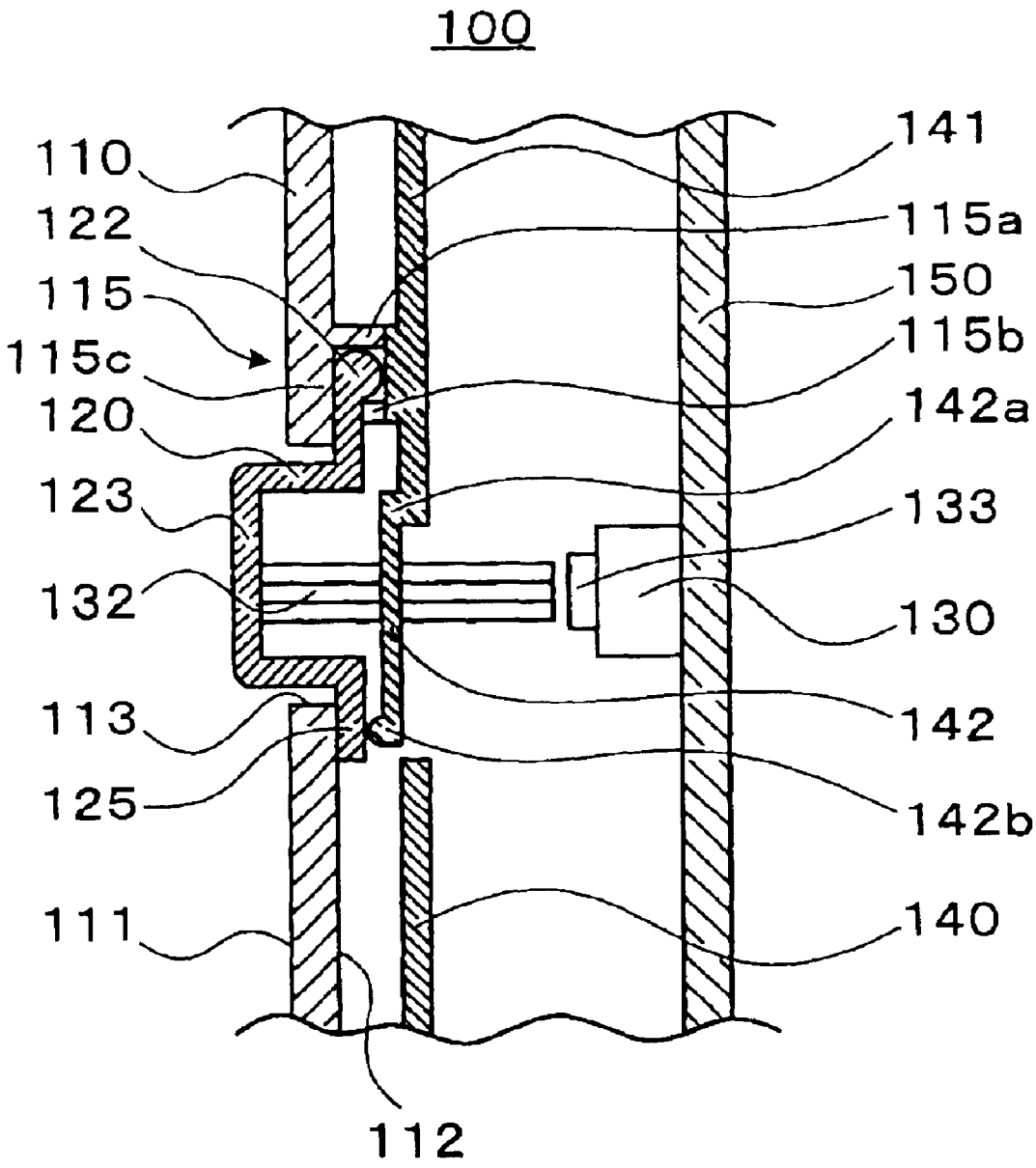
FIG. 1 is an enlarged fragmentary cross-sectional view of a preferred embodiment of the switching apparatus according to the present invention.

Referring now to the drawings, in particular to FIGS. 1 to 4, there is shown the preferred embodiments of the switching apparatus and the vehicle-mounted electronic apparatus having assembled therein the switching apparatus according to the present invention. Throughout the following detailed description, similar reference characters and numbers refer to respective similar elements in all figures of the drawings.

The constitution of the preferred embodiment of the switching apparatus 100 according to the present invention will firstly be described hereinafter with reference to FIGS. 1 to 3.

Figure 2:
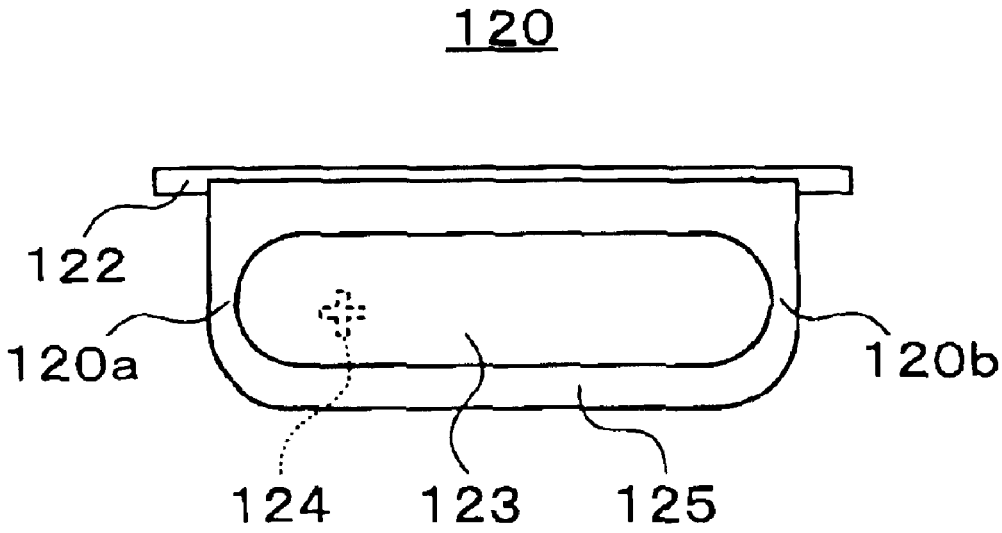
FIG. 2 is a front view of a push button forming part of the preferred embodiment of the switching apparatus according to the present invention.
Figure 3:
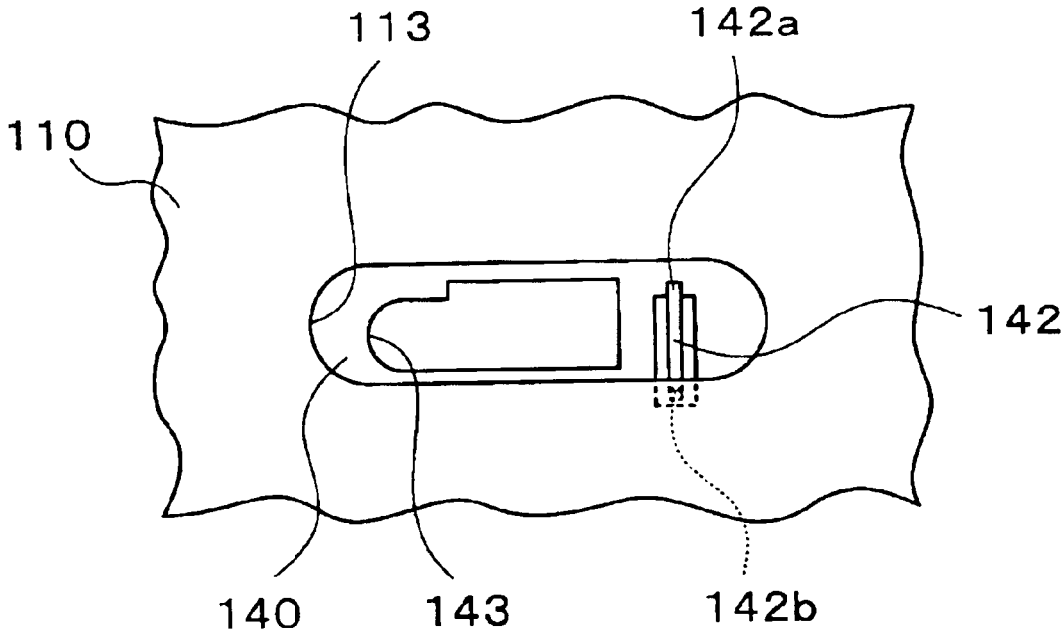
FIG. 3 is a front view of a front panel and a stationary supporting panel forming part of the preferred embodiment of the switching apparatus according to the present invention.

The switching apparatus 100 is shown in FIGS. 1 to 3 as comprising a rear panel 150, a front panel 110, a switch device 130, a push button 120, and a stationary supporting panel 140.

The front panel 110 is spaced apart from the rear panel 150 and has a first surface 111 outwardly exposed and a second surface 112 in face-to-face relationship with the rear panel 150. The front panel 110 is formed with a through bore 113. The through bore 113 has an outer open end flush with the first surface 111 and an inner open end flush with the second surface 112.

The switch device 130 includes a stationary contact member 133 fixedly mounted on the rear panel 150, and a movable contact member 132 movable with respect to the stationary contact member 133. The switch device 130 assumes two different positions including a switch-on position in which the movable contact member 132 is brought in contact with the stationary contact member 133 to establish electrical connection between the movable contact member 132 and the stationary contact member 133 and a switch-off position in which the movable contact member 132 is brought out of contact with the stationary contact member 133 to establish electrical disconnection between the movable contact member 132 and the stationary contact member 133. The rear panel 150 may have a printed circuit board mounted thereon.

The push button 120 has a pushed portion 123. The pushed portion 123 has a center axis extending substantially in perpendicular relationship with the first surface 111 of the front panel 110 and received in the through bore 113 of the front panel 110. The push button 120 is designed to support the movable contact member 132 of the switch device 130 to be reciprocatable along the center axis of the pushed portion 123 together with the movable contact member 132 of the switch device 130. The push button 120 is operative to assume two different positions including a projected position in which the pushed portion 123 is projected outwardly of the first surface 111 of the front panel 110 to have the movable contact member 132 move with respect to the stationary contact member 133 toward the switch-off position and a retracted position in which the pushed portion 123 is at least partly retracted into the through bore 113 to have the movable contact member 132 move with respect to the stationary contact member 133 toward the switch-on position.

The stationary supporting panel 140 is disposed between the rear panel 150 and the front panel 110 to resiliently urge the push button 120 against the second surface 112 of the front panel 110 toward the projected position. The stationary supporting panel 140 is made of plastic material. The stationary supporting panel 140 is fixedly supported on at least one of the rear panel 150 and the front panel 110 to be retained at a stationary position.

The present embodiment of the switching apparatus 100 according to the present invention, in which the stationary supporting panel 140 is operative to resiliently urge the push button 120 against the second surface 112 of the front panel 110 toward the projected position, can have the push button 120 stationary held in the projected position regardless of whether or not the movable contact member 334 of the switch device 330 is opposing to and held in contact with the pushed portion 323 of the push button 320. This means that the fact that the present embodiment of the switching apparatus 100 according to the present invention can prevent the push button 120 from being rattled especially when an external vibration is imparted to the switching apparatus 100 regardless of whether or not the pushed portion 123 of the push button 120 is reciprocatable along the center axis of the pushed portion 123 with a long stroke. This leads to the fact that the present embodiment of the switching apparatus 100 according to the present invention can prevent the rattling noise from occurring. Furthermore, the switching apparatus 100 thus constructed can eliminate the need of any sound absorption material used for the push button or the front panel. This leads to the fact that the present embodiment of the switching apparatus 100 according to the present invention is noiseless in operation and simple in construction.

The following description will be directed to how the push button 120 is supported on the front panel 110 with reference to FIG. 1.

The push button 120 includes a horn projection 122. The horn projection 122 has a center axis. The stationary supporting panel 140 includes a base section 141 held in pressing contact with the horn projection 122 to have the horn projection 122 pivotably received on the second surface 112 of the front panel 110. More specifically, the front panel 110 is formed with a groove 114 open at the second surface 112 and the horn projection 122 of the push button 120 is pivotably received in the groove 114. Preferably, the front panel 110 should include a holder portion 115 on the second surface 112. The holder portion 115 has a bottom plate **115*c* fixedly supported on the front panel 110, a first plate 115*a* and a second plate 115*b* opposing to and spaced apart from each other across the bottom plate 115*c*. The first plate 115*a* and the second plate 115*b* are fixedly supported on the bottom plate 115*c*. Here, the first plate 115*a* and the second plate 115*b* may be integrally formed with the bottom plate 115*c*, and the bottom plate 115*c* may be integrally formed with the front panel 110. The first plate 115*a*, the second plate 115*b*, and the bottom plate 115*c* are extending substantially along the center axis of the horn projection 122 to form a groove 114 having the horn projection 122 received therein. The base section 141 of the stationary supporting panel 140 is designed to cover the groove 114 to define a closed space having the horn projection 122 pivotably held therein. The stationary supporting panel 140 further includes an urging section 142 designed to resiliently urge the push button 120 against the second surface 112 of the front panel 110** toward the projected position.

The following description will be directed to the construction of the push button 120 with reference to FIGS. 1 and 2.

The push button 120 has a pushing end portion **120*a* disposed in face-to-face relationship with the movable contact member 132 of the switch device 130 and an urged end portion 120***b* disposed in face-to-face relationship with the urging section 142 of the stationary supporting panel 140. The pushing end portion 120*a* and the urged end portion 120*b* are opposing to and spaced apart from each other along the center axis of the horn projection 122. The fact that the pushing end portion 120*a* and the urged end portion 120*b* are opposing to and spaced apart from each other along the center axis of the horn projection 122 leads to the fact that the pushed button 12 can be resiliently urged by the urging section 142 of the stationary supporting panel 140 and the movable contact member 132 of the switch device 130 evenly, thereby ensuring that the push button 120 assumes the projected position while the pushed portion 123 is not being pressed.

The following description will be directed to the construction of the stationary supporting panel 140 with reference to FIGS. 1 and 3.

The push button 120 has a flange portion 125 extending radially and outwardly of and integrally formed with the pushed portion 123. As best shown in FIG. 1, the flange portion 125 of the push button 120 extends inwardly of the inner open end of the through bore 113. The urging section 142 of the stationary supporting panel 140 is held in pressing contact with the flange portion 125 of the push button 120 with the result that the urging section 142 of the stationary supporting panel 140 is operative to resiliently urge the flange portion 125 of the push button 120 against the second surface 112 of the front panel 110 toward the projected position. In the present embodiment of the switching apparatus 100 according to the present invention, the length of the urging section 142 of the stationary supporting panel 140 can be designed flexible as long as the urging section 142 of the stationary supporting panel 140 can resiliently urge the flange portion 125 of the push button 120 toward the projected position, thereby enhancing the degree of freedom of designing the switching apparatus 100.

The switching apparatus 100 further comprises an internal light, not shown, disposed opposing to and spaced apart from the second surface 112 of the front panel 110. The internal light is operative to project a light on the second surface 112 of the front panel 110 to illuminate the pushed portion 123 of the push button 120. The stationary supporting panel 140 is made of a light blocking material and disposed between the front panel 110 and the internal light to intercept the light projected by the internal light on the second surface 112 of the front panel 110. The stationary supporting panel 140 has a light passing hole 143 therein to have the light partly passing therethrough. In the switching apparatus 100 according to the present invention, the urging section 142 thus constructed can serve as a light blocking plate to selectively block the light projected by the internal light, thereby enabling to reduce the number of constituent elements to be incorporated in switching apparatus 100 according to the present invention.

The urging section 142 of the stationary supporting panel 140 has a first end portion 142*a* fixedly connected with the base section 141 of the stationary supporting panel 140 and a second end portion 142*b* held in pressing contact with the flange portion 125 of the push button 120. As best shown in FIG. 3, the second end portion 142*b* of the urging section 142 is spaced apart from the light passing hole 143 so that the urging section 142 of the stationary supporting panel 140 does not intercept the light passing through the light passing hole 143. This means that the urging section 142 is designed to resiliently urge the push button 120 at a point 142*b* spaced apart from the light passing hole 143 so as to prevent the urging section 142 of the stationary supporting panel 140 from intercepting the light passing through the light passing hole 143. In the switching apparatus 100 according to the present invention, the urging section 142 thus constructed can have the light undisturbedly passing through the light passing hole 143, thereby making it possible for the internal light to project a light on the second surface 112 of the front panel 110 undisturbedly with the result that the pushed portion 123 of the push button 120 is uniformly illuminated.

As will be seen from the foregoing description, it will be understood that the switching apparatus 100 according to the present invention, comprising a rear panel 150, a front panel 110 spaced apart from the rear panel 150 and having a first surface 111 outwardly exposed and a second surface 112 in face-to-face relationship with the rear panel 150, the front panel 110 being formed with a through bore 113 having an outer open end flush with the first surface 111 and an inner open end flush with the second surface 112, a switch device 130 including a stationary contact member 133 fixedly mounted on the rear panel 150, and a movable contact member 132 movable with respect to the stationary contact member 133 to assume two different positions including a switch-on position in which the movable contact member 132 is brought in contact with the stationary contact member 133 to establish electrical connection between the movable contact member 132 and the stationary contact member 133 and a switch-off position in which the movable contact member 132 is brought out of contact with the stationary contact member 133 to establish electrical disconnection between the movable contact member 132 and the stationary contact member 133, a push button 120 having a pushed portion 123 having a center axis extending substantially in perpendicular relationship with the first surface 111 of the front panel 110 and received in the through bore 113 of the front panel 110, the push button 120 supporting the movable contact member 132 of the switch device 130 to be reciprocatable along the center axis of the pushed portion 123 together with the movable contact member 132 of the switch device 130 to assume two different positions including a projected position in which the pushed portion 123 is projected outwardly of the first surface 111 of the front panel 110 to have the movable contact member 132 move with respect to the stationary contact member 133 toward the switch-off position and a retracted position in which the pushed portion 123 is retracted into the through bore 113 to have the movable contact member 132 move with respect to the stationary contact member 133 toward the switch-on position, and a stationary supporting panel 140 disposed between the rear panel 150 and the front panel 110 to resiliently urge the push button 120 toward the projected position, can have the push button 120 stationary held in the projected position regardless of whether or not the movable contact member 334 of the switch device 330 is opposing to and held in contact with the pushed portion 323 of the push button 320. This means that the fact that the present embodiment of the switching apparatus 100 according to the present invention can prevent the push button 120 from being rattled especially when an external vibration is imparted to the switching apparatus 100 regardless of whether or not the pushed portion 123 of the push button 120 is reciprocatable along the center axis of the pushed portion 123 with a long stroke. This leads to the fact that the present embodiment of the switching apparatus 100 according to the present invention can prevent the rattling noise from occurring. Furthermore, the switching apparatus 100 thus constructed can eliminate the need of any sound absorption material used for the push button or the front panel. This leads to the fact that the present embodiment of the switching apparatus 100 according to the present invention is noiseless in operation and simple in construction.

Figure 4:
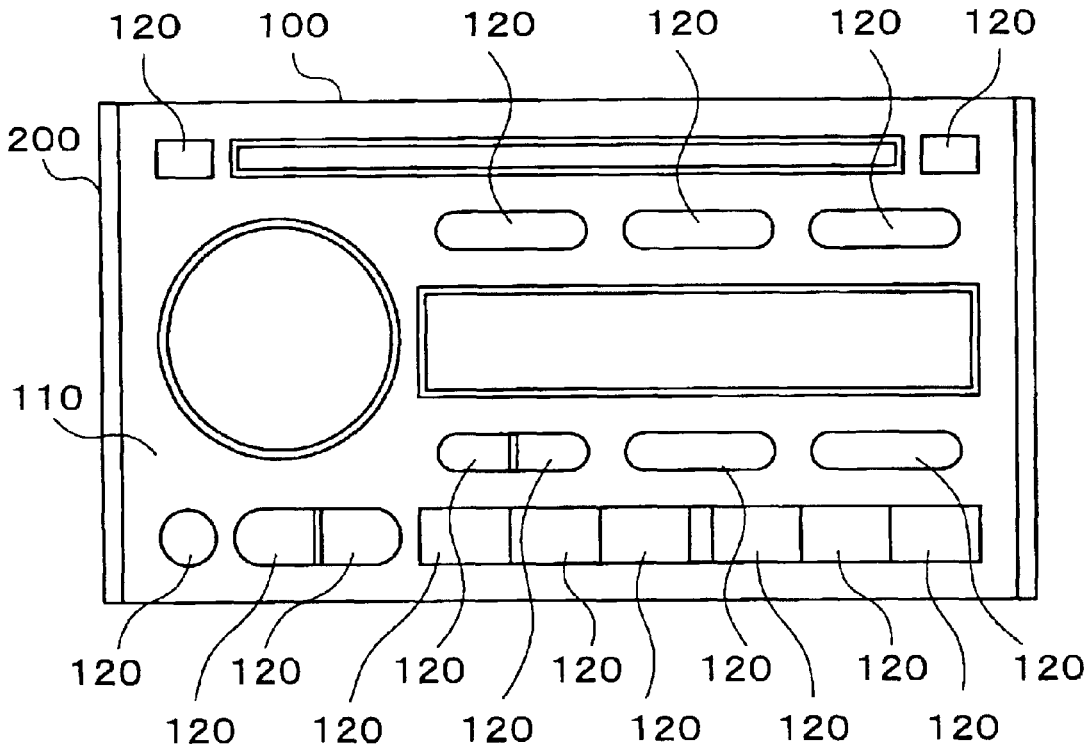
FIG. 4 is a front view of the preferred embodiment of the switching apparatus and the vehicle-mounted electronic apparatus having assembled therein the switching apparatus according to the present invention.
Figure 5:
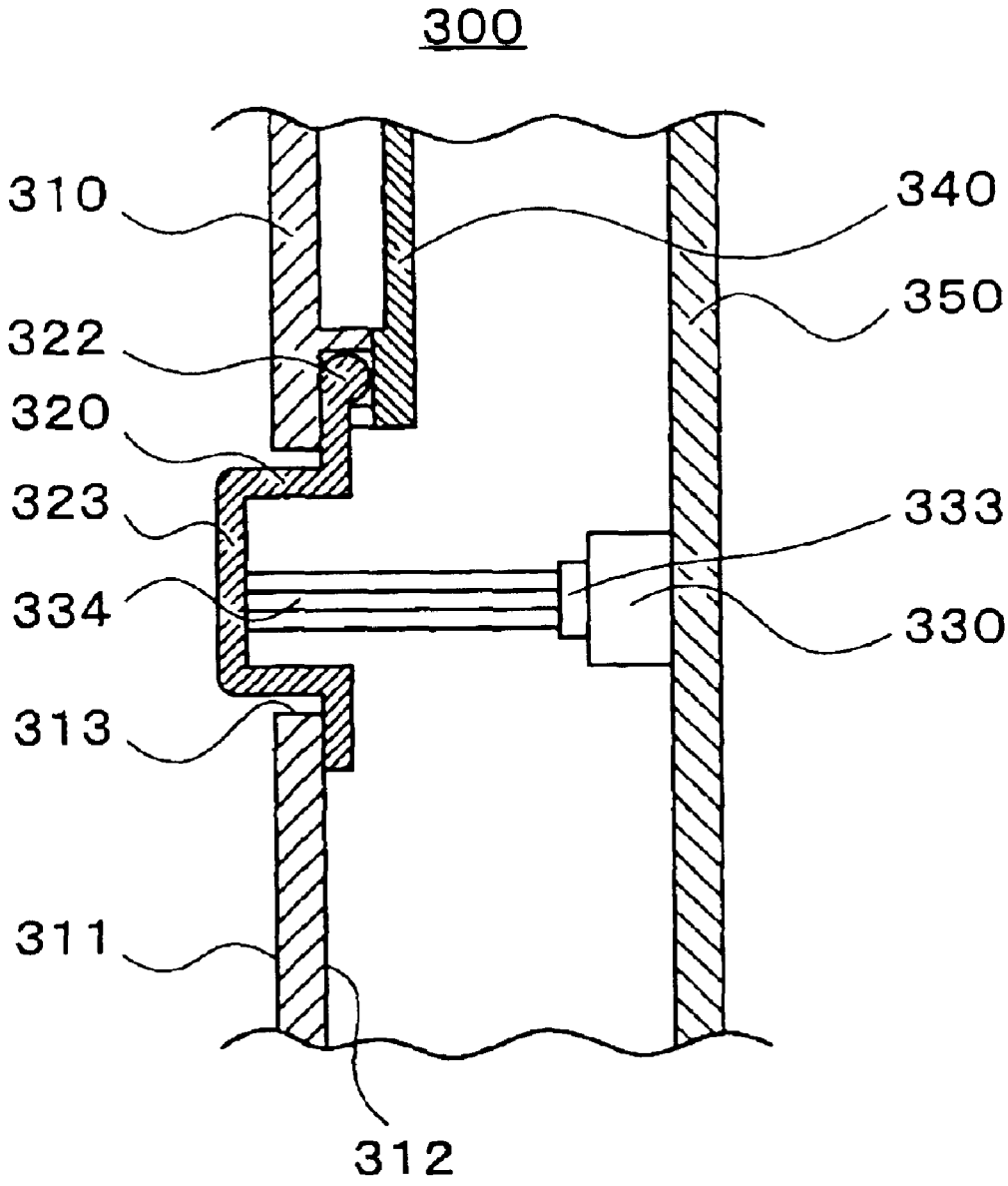
FIG. 5 PRIOR ART
FIG. 5 is an enlarged fragmentary cross-sectional view of the conventional switching apparatus according to the present invention.

The following description will be directed to a vehicle-mounted electronic apparatus 200 having assembled therein the switching apparatus 100 according to the present invention with reference to FIG. 4. Throughout the following detailed description, similar reference characters and numbers refer to similar elements in all figures of the drawings.

The vehicle-mounted electronic apparatus 200 is to be mounted on a vehicle, and comprises an electric device such as, for example, a DVD (Digital Versatile Disc) Video player, CD (Compact Disc) Video player, a cassette tape player, a radio receiver, or the like for the purpose of simple in construction and inexpensive in production cost. The vehicle-mounted electronic apparatus 200 is shown in FIG. 4 as having assembled therein a switching apparatus 100 according to the present invention. The switching apparatus 100 comprises a rear panel, not shown in FIG. 4, a front panel 110, a switch device 130, not shown in FIG. 4, a plurality of push buttons 120, and a stationary supporting panel 140, not shown in FIG. 4, all of which are substantially the same in construction as the first embodiment of the switching apparatus according to the present invention and thus their constructions will not be described hereinlater. The front panel 110 partly constitutes a front panel of the vehicle-mounted electronic apparatus 200.

As will be seen from the foregoing description, it will be understood that the vehicle-mounted electronic apparatus having assembled therein the switching apparatus 100 according to the present invention, comprising a rear panel 150, a front panel 110 spaced apart from the rear panel 150 and having a first surface 111 outwardly exposed and a second surface 112 in face-to-face relationship with the rear panel 150, the front panel 110 being formed with a through bore 113 having an outer open end flush with the first surface 111 and an inner open end flush with the second surface 112, a switch device 130 including a stationary contact member 133 fixedly mounted on the rear panel 150, and a movable contact member 132 movable with respect to the stationary contact member 133 to assume two different positions including a switch-on position in which the movable contact member 132 is brought in contact with the stationary contact member 133 to establish electrical connection between the movable contact member 132 and the stationary contact member 133 and a switch-off position in which the movable contact member 132 is brought out of contact with the stationary contact member 133 to establish electrical disconnection between the movable contact member 132 and the stationary contact member 133, a push button 120 having a pushed portion 123 having a center axis extending substantially in perpendicular relationship with the first surface 111 of the front panel 110 and received in the through bore 113 of the front panel 110, the push button 120 supporting the movable contact member 132 of the switch device 130 to be reciprocatable along the center axis of the pushed portion 123 together with the movable contact member 132 of the switch device 130 to assume two different positions including a projected position in which the pushed portion 123 is projected outwardly of the first surface 111 of the front panel 110 to have the movable contact member 132 move with respect to the stationary contact member 133 toward the switch-off position and a retracted position in which the pushed portion 123 is retracted into the through bore 113 to have the movable contact member 132 move with respect to the stationary contact member 133 toward the switch-on position, and a stationary supporting panel 140 disposed between the rear panel 150 and the front panel 110 to resiliently urge the push button 120 toward the projected position, can prevent the push button 120 from being rattled especially when a vehicle vibration is imparted to the vehicle-mounted electronic apparatus 200. This means that the vehicle-mounted electronic apparatus 200 can prevent the rattling noise from occurring, and thus eliminate the need of any sound absorption material used for the push button or the front panel. This leads to the fact that the vehicle-mounted electronic apparatus according to the present invention can be noiseless in operation and simple in construction.

Though it has been described in FIG. 3 of the drawings that the urging section 142 of the stationary supporting panel 140 extends between the first end portion 142*a* fixedly connected with the base section 141 of the stationary supporting panel 140 and the second end portion 142*b* held in pressing contact with the flange section 125 of the push button 120, the switching apparatus 100 according to the present invention may be constituted by any other means as long as the stationary supporting panel 140 has a first end portion fixedly connected with the base section 141 of the stationary supporting panel 140 and a second end portion held in pressing contact with the flange section 125 of the push button 120. This means that the urging section 142 of the stationary supporting panel 140 may be any means such as, for example, a long rod member having a first portion fixedly connected with the base section 141 of the stationary supporting panel 140 and a second portion held in pressing contact with the flange section 125 of the push button 120 therebetween, and further extending beyond the first end portion and the second end portion.

While the present invention has thus been shown and described with reference to the specific embodiments, however, it should be noted that the invention is not limited to the details of the illustrated structures but changes and modifications may be made without departing from the scope of the appended claims.

What is claimed is:

1. A switching apparatus, comprising: a rear panel; a front panel spaced apart from said rear panel and having a first surface outwardly exposed and a second surface in face-to-face relationship with said rear panel, said front panel being formed with a through bore having an outer open end flush with said first surface and an inner open end flush with said second surface; a switch device including a stationary contact member fixedly mounted on said rear panel, and a movable contact member movable with respect to said stationary contact member to assume two different positions including a switch-on position in which said movable contact member is brought in contact with said stationary contact member to establish electrical connection between said movable contact member and said stationary contact member and a switch-off position in which said movable contact member is brought out of contact with said stationary contact member to establish electrical disconnection between said movable contact member and said stationary contact member; a push button having a pushed portion having a center axis extending substantially in perpendicular relationship with said first surface of said front panel and received in said through bore of said front panel, said push button supporting said movable contact member of said switch device to be reciprocatable along said center axis of said pushed portion together with said movable contact member of said switch device to assume two different positions including a projected position in which said pushed portion is projected outwardly of said first surface of said front panel to have said movable contact member move with respect to said stationary contact member toward said switch-off position and a retracted position in which said pushed portion is retracted into said through bore to have said movable contact member move with respect to said stationary contact member toward said switch-on position; and a stationary supporting panel disposed between said rear panel and said front panel, said push button further including a horn projection having a center axis, and said stationary supporting panel including a base section held in pressing contact with said horn projection to have said horn projection pivotably received on said second surface of said front panel, and said stationary supporting panel including an urging section designed to resiliently urge said push button toward said projected position.

2. A switching apparatus as set forth in claim 1, in which said push button has a pushing end portion disposed in face-to-face relationship with said movable contact member of said switch device and an urged end portion disposed in face-to-face relationship with said urging section of said stationary supporting panel, and said pushing end portion and said urged end portion opposing to and spaced apart from each other along said center axis of said horn projection.

3. A switching apparatus as set forth in claim 1, in which said push button has a flange portion extending radially and outwardly of and integrally formed with said pushed portion, said flange portion of said push button extending inwardly of said inner open end of said through bore, and said stationary supporting panel is operative to resiliently urge said flange portion of said push button toward said projected position.

4. A switching apparatus as set forth in claim 1, which further comprises: an internal light disposed opposing to and spaced apart from said second surface of said front panel and operative to project a light on said second surface of said front panel, and in which said stationary supporting panel is disposed between said front panel and said internal light, made of a light blocking material, and has a light passing hole therein to have said light passing therethrough.

5. A switching apparatus as set forth in claim 4, which said urging section of said stationary supporting panel is designed to resiliently urge said push button at a point spaced apart from said light passing hole to prevent said urging section of said stationary supporting panel from intercepting said light passing through said light passing-hole.

6. A switching apparatus as set forth in claim 1, in which said front panel is formed with a groove open at said second surface and said horn projection of said push button is received in said groove.

7. A switching apparatus as set forth in claim 1, in which said front panel includes a holder portion on said second surface, said holder portion has a bottom plate fixedly supported on said front panel, a first plate and a second plate opposing to and spaced apart from each other across said bottom plate, said first plate and said second plate fixedly supported on said bottom plate, and said first plate, said second plate, and said bottom plate extending substantially along said center axis of said horn projection to form a groove having said horn projection.

8. A switching apparatus as set forth in claim 1, in which said stationary supporting panel is fixedly supported on at least one of said rear panel and said front panel to be retained at a stationary position.

9. A switching apparatus as set forth in claim 1, in which said stationary supporting panel is made of plastic material.

10. A vehicle-mounted electronic apparatus to be mounted on a vehicle and having assembled therein said switching apparatus as set forth in claim 1.

11. A switching apparatus, comprising: a support member having a first surface and a second surface opposing to said first surface, said support member being formed with a through bore having an outer open end flush with said first surface and an inner open end flush with said second surface; a switch device operative to perform a switching action; a push button having a pushed portion reciprocatable through said through bore to assume two different positions including a projected position in which said pushed portion is projected outwardly of said first surface of said front support member to have said switch device perform a switch-off action and a retracted position in which said pushed portion is retracted into said through bore to have said switch device perform a switch-on action; and a stationary supporting panel disposed on the side of said second surface of said support member, said push button further including a horn projection having a center axis, and said stationary supporting panel including a base section held in pressing contact with said horn projection to have said horn projection pivotably received on said second surface of said front panel, and said stationary supporting panel including an urging section designed to resiliently urge said push button toward said projected position.

* * * * *